United States Patent [19]

Chirinos et al.

[11] Patent Number: 4,781,819

[45] Date of Patent: Nov. 1, 1988

[54] TREATMENT OF VISCOUS CRUDE OILS

[75] Inventors: Maria L. Chirinos, Caracas; Jorge L. Grosso; Ignacio Layrisse, both of Miranda, all of Venezuela; Alan Stockwell, Knaphill, United Kingdom

[73] Assignees: The British Petroleum Company p.l.c., London, England; Intevep SA, Caracas, Venezuela

[21] Appl. No.: 888,109

[22] Filed: Jul. 21, 1986

Related U.S. Application Data

[63] Continuation of Ser. No. 628,523, Jul. 6, 1984, abandoned.

[30] Foreign Application Priority Data

Jul. 6, 1983 [GB] United Kingdom ..... 8318313

[51] Int. Cl.[4] ..... C10C 3/00

[52] U.S. Cl. ..... 208/309; 208/34; 208/45; 208/188; 208/370; 210/708; 210/709; 210/729

[58] Field of Search ..... 208/309, 370, 34, 45, 208/188; 210/708, 709, 729

[56] References Cited

U.S. PATENT DOCUMENTS

| | | | |
|---|---|---|---|
| 2,010,007 | 8/1935 | Bray | 208/309 |
| 2,041,278 | 5/1936 | Aldridge et al. | 208/309 |
| 2,045,742 | 6/1936 | Winning et al. | 208/309 |
| 2,141,361 | 12/1938 | Pilat | 208/309 |
| 2,192,253 | 3/1940 | Adams | 208/309 |
| 2,218,516 | 10/1940 | Bray | 208/34 |
| 2,446,040 | 7/1948 | Blair Jr. | 208/251 R |
| 2,894,904 | 7/1959 | Hardman et al. | 208/309 |
| 3,053,750 | 9/1962 | Beuther et al. | 208/309 |
| 3,074,882 | 1/1963 | Gross et al. | 208/309 |
| 3,136,711 | 6/1964 | Glaser et al. | 208/370 |
| 3,291,718 | 12/1966 | Biribaur et al. | 208/309 |
| 3,334,043 | 8/1967 | Ferris et al. | 208/309 |
| 3,396,100 | 8/1968 | Pettefer | 208/188 |
| 3,696,021 | 10/1972 | Cole et al. | 208/188 |
| 4,021,335 | 5/1977 | Beaton | 208/309 |
| 4,101,415 | 7/1978 | Crowley | 208/309 |
| 4,125,459 | 11/1978 | Garwin | 208/309 |
| 4,155,833 | 5/1979 | Gleim | 208/309 |
| 4,634,520 | 1/1987 | Angelov et al. | 210/708 |

FOREIGN PATENT DOCUMENTS

| | | | |
|---|---|---|---|
| 1687107 | 9/1979 | U.S.S.R. | 208/309 |
| 1384290 | 2/1975 | United Kingdom | 208/309 |

*Primary Examiner*—Curtis R. Davis
*Assistant Examiner*—Helane Myers
*Attorney, Agent, or Firm*—Morgan & Finnegan

[57] ABSTRACT

Asphaltenes and/or wax and/or water are removed from crude oil by contacting the crude oil with an organic solvent to dissolve the crude oil and precipitate asphaltenes and/or wax and separate the oil and water. Solvent is then separated from the deasphalted and/or dewaxed and/or dehydrated crude oil.

Removing asphaltenes, wax and/or water reduces the viscosity of the crude oil and it can then be transported, e.g. by pumping through a pipeline, with less expenditure of energy.

13 Claims, 1 Drawing Sheet

TREATMENT OF VISCOUS CRUDE OILS

This is a continuation of co-pending application Ser. No. 628,523 filed on July 6, 1984 now abandoned.

This invention relates to a method for reducing the viscosity of viscous crude oils by removing asphaltenes and heavy metals such as nickel and vanadium in the case of heavy crude and waxes in the case of lighter crudes.

Many crude oils are viscous when produced and are thus difficult, if not impossible, to transport by normal methods from the production location to a refinery. Such crude oils often contain high concentrations of asphaltenes or wax and co-produced water, which is frequently saline, dispersed as small droplets. These materials increase the viscosity of the crude oil.

Several methods have been devised for the transportation of such crudes by pipeline. These include (1) heating the crude and insulating the pipeline, (2) adding a non-recoverable solvent, (3) adding a recoverable solvent, (4) adding a lighter crude, (5) forming an annulus of water around the crude and (6) emulsifying the crude in water.

Methods (1)–(4) can be expensive in terms of added components and capital expenditure and Method (5) is technically difficult to achieve. Method (6), whilst superficially attractive, presents special difficulties. The dispersion of a highly viscous oil in a medium of much lower viscosity is an unfavourable process on hydrodynamic grounds.

We have now discovered that removing asphaltenes and/or wax from crude oils results in a lowering of viscosity which renders them more tractable.

Thus according to the present invention there is provided a method for the removal of asphaltenes and/or wax from crude oil which method comprises the steps of contacting the crude oil with an organic solvent to dissolve the crude oil and precipitate asphaltenes and/or wax, separating the asphaltenes and/or wax from the oil and solvent, and separating solvent from the deasphalted and/or dewaxed crude oil.

Heavy metals such as vanadium and nickel are almost always associated with asphaltene and porphyrin molecules which are also precipitated and hence the method also serves to reduce the concentration of these materials.

Suitable solvents include normally liquid paraffinic hydrocarbons such as pentane, hexane and heptane, and mixed solvents such as naphtha.

The ratio of the volume of solvent required to the volume of the crude oil for deasphalting and/or dewaxing is preferably in the range 1:10 to 8:1.

Contact is preferably effected at a temperature in the range 40° to 60° C. and a period of between 1 to 10 minutes.

The solvent may be separated from the deasphalted and/or dewaxed crude oil by distillation and recovered for further use.

Suitable viscous, heavy and/or asphaltenic crude oils for treatment are to be found in Canada, the USA and Venezuela, for example Lake Marguerite crude oil from Alberta, Hewitt crude oil from Okalahoma and Cerro Negro crude oil from the Orinoco oil belt.

Generally the API Gravity is in range 5° to 15°, although the method can be applied to crude oils outside this API range in special circumstances. For example the method can also be applied to non-asphaltenic crude oils such as Beatrice from the UK sector of the North Sea. This crude oil (30° API) is viscous because of its high wax content and the subsequent gel structure developed by intermolecular association of wax components.

It will generally be found that the viscosity of such crude oils can be reduced by a factor of 10 to 100 times following deasphalting and/or dewaxing and removal of solvent.

As stated previously, following production, the crude oil can contain water to a greater or lesser extent and this needs to be removed. The action of water removal is termed crude oil dehydration. Some emulsions may be broken down by heat alone but more often it is necessary to add a surface tension reducing chemical to achieve this end. Generally the application of heat and/or chemical is sufficient to reduce the water content, and more importantly the salt content, to an acceptable level but sometimes it is necessary to use electrostatic precipitation.

A dehydrated oil normally contains between 0.1 and 1.0% by volume of water. However, if the salinity of the remaining water is high, the salt content of the crude oil will also be high, eg 100–1,000 ptb (pounds salt per 1,000 barrels of crude oil, equivalent to 300 to 3,000 ppm), even when such low quantities of water are present. This is undesirable because the presence of salt reduces the value of the crude oil, leads to the corrosion of pipelines and downstream distillation columns and, additionally, poisons catalysts which may be used in downstream refining processes.

With most crude oils it is necessary to remove the salt from the crude oil by washing with fresh water or a low salinity aqueous phase, imparting a degree of mixing to ensure adequate contact between high salinity water in the crude and low salinity wash water, and then carrying out the separation process by any of the means described above. This combined process is termed crude oil desalting.

The two processes of dehydration and desalting may both be carried out at the production location to give a crude oil with about 0.1% water and 20 ptb salt. Furthermore an additional desalting process may be carried out after the crude oil is received at a refinery.

We have further discovered that if a crude oil containing dispersed salt water is treated with a suitable solvent as hereinbefore described, then in addition to the asphaltenes and/or wax being precipitated, the dispersion of salt water in the crude oil is more easily removed and the crude oil can be more readily dehydrated and desalted.

Thus according to a further aspect of the present invention there is provided a method for the removal of asphaltenes and/or wax and water, which may be salt water, from crude oil which method comprises the steps of contacting the crude oil with an organic solvent to dissolve the crude oil and precipitate asphaltenes and/or wax and separate the oil and water, separating the asphaltenes and/or wax and water from the oil and solvent, and separating solvent from the deasphalted and/or dewaxed, dehydrated and/or desalted crude oil.

The method relies on the addition of an organic solvent which also facilitates the dehydration/desalting of the crude oil.

Suitable solvents include those previoussly mentioned, ie, pentane, hexane and heptane, and mixed solvents such as naphtha.

Conditions of treatment are also similar.

The addition of the solvent and the precipitation of the asphaltenes and/or wax both have the effect of reducing the viscosity and density of the continuous oil phase, thereby increasing the difference in density between the continuous oil phase and the dispersed water phase. These factors increase the rate of settling of the water.

Dehydration and desalting can be carried out together or separately as preliminary treatments. Alternatively, dehydration can be effected as a pretreatment and desalting carried out together with deasphalting. As a further variation, dehydration, desalting and deasphalting and/or dewaxing can all take place simultaneously.

When desalting is carried out as a separate operation, facilities for the supply of fresh water or water of low salinity should be provided.

Demulsifiers may be added to facilitate dehydration and desalting. Demulsifiers usually consist of one or more surface active chemicals dissolved or blended in a carrier solvent and are manufactured and supplied by a variety of chemical and service companies.

Suitable demulsifiers include nonyl phenol ethoxylates and ethoxylated phenolic formaldehyde resin adducts.

The quantity of solvent required for the pretreatment is less than that required for complete deasphalting and/or dewaxing and is suitably in the range 5 to 50% by volume of the crude oil, the remainder being added subsequently to the main treatment.

The asphalt residue removed from the crude oil can be used as a fuel and transported to its place of use in the form of an aqueous slurry or emulsion by adding water and an emulsifying agent. The water used can be either fresh or recovered from the dehydration/desalting of the crude oil.

Simultaneous dehydration, desalting and deasphalting has the advantage that the asphaltenes can be removed with the separated water, thus pre-empting the requirement for a separate dehydration tank or the addition of fresh water.

Because the viscosity of the crude oil is lowered by deasphalting and/or dewaxing, and dehydration if water is initially present, the treated crude will generally be suitable for transportation by pipeline with relatively low expenditure of energy.

Thus according to another aspect of the present invention there is provided a method for the transportation of a viscous crude oil which method comprises the steps of removing asphaltenes and/or wax and/or salt water by a method as hereinbefore described and pumping the treated crude oil through a pipeline.

BRIEF DESCRIPTION OF THE DRAWINGS

The invention is illustrated with reference to FIGS. 1 and 2 of the accompanying drawings which are schematic flow diagrams.

Figure 1:
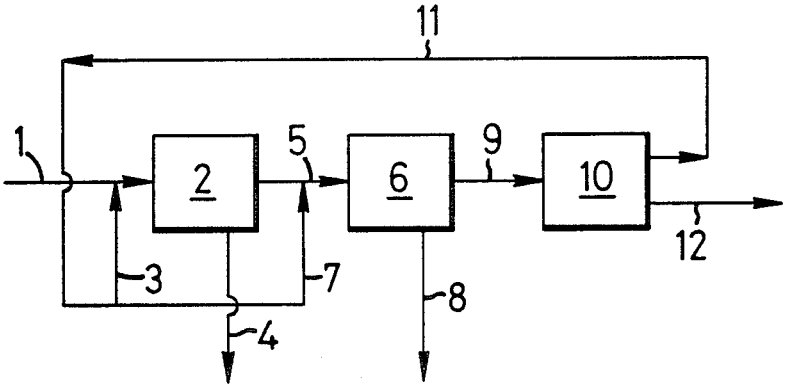
With reference to FIG. 1, wet crude oil containing either free water or water dispersed as small droplets in the form of an emulsion is fed by line 1 to a dehydration separator 2. Solvent is added to the crude oil by line 3 before it enters the separator. The solvent is a mixture of low molecular weight hydrocarbons with an average carbon number of 5 and is added to the crude oil in amount 15% by volume.

The presence of the solvent decreases the viscosity of the crude oil, thus enabling the free water to settle out more easily and enabling the dispersed droplets to flocculate, coalesce and settle more rapidly following the addition of a suitable demulsifier.

Alternatively, the solvent may be added nearer to the wellhead so that it can facilitate transportation.

In the dehydration tank, most of the water settles into a bottom layer beneath the top layer of oil and solvent and is removed by line 4.

The oil layer which may contain a small amount of water, perhaps up to 2% by volume, is taken from the dehydration separator by line 5 to a deasphalting unit 6. A second addition of solvent is made through line 7 before the oil enters the unit. The amount of solvent added on this occasion is in the range 0.1 to 8 times the volume of the crude oil.

In the deasphalting unit, asphaltenes, heavy metals and any remaining water are removed by line 8.

The crude oil and solvent then pass by line 9 to a distillation or evaporation unit 10 in which the solvent is separated from the crude oil.

The former is recycled through line 11 and the latter removed by line 12. The water and salt contents of the treated crude are also less than 0.2% and 5 ptb (15 ppm), respectively.

Figure 2:
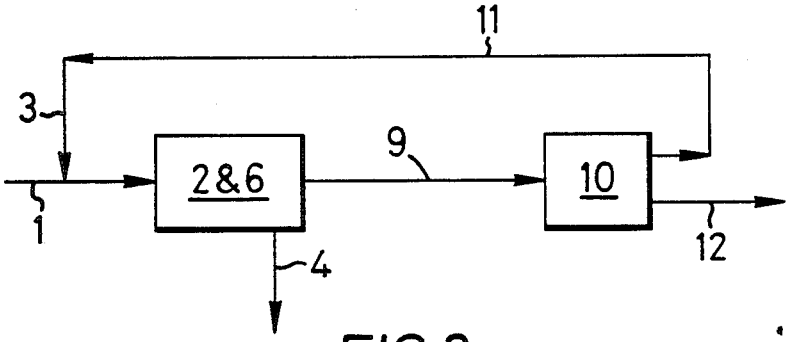

FIG. 2 illustrates a similar process in which dehydration and deasphalting are combined in a single unit.

The invention is further illustrated with reference to the following examples.

EXAMPLE 1

Cerro Negro crude oil (CN 38) was deasphalted using n-pentane as solvent in a batchwise operation. The ratio of pentane to crude oil was 6:1 by weight or 10:1 by volume. The mixture was agitated for 20 minutes using a magnetic stirrer and after a further hour then centrifuged for 30 minutes at 4000 rpm. The supernatant liquid was extracted and the solvent removed by evaporation. The upgraded crude oil was then subjected to the same tests as the as-received crude oil and comparisons made.

Table 1 clearly illustrates the differences between the general properties of the as-received and deasphalted crude oils. Note particularly the substantial increase in API gravity and the decrease in metals content and viscosity. Table 2 shows the large difference in viscosity between the two crude oils.

TABLE 1

Properties of CN-38 and Deasphalted CN-38

| | CN-38 | Deasphalted CN-38 |
|---|---|---|
| Gravity °API | 8.1 | 12.2 |
| Specific Gravity | 1.0136 | 0.9845 |
| Asphaltene % (w/w) | 11.44 | 0 |
| Vanadium (ppm) | 407 | 174 |
| Nickel (ppm) | 90 | 35 |
| Viscosity (cp), 38° C. (100° F.) | 80,000 | 2,650 |
| Viscosity (cp), 60° C. (140° F.) | 6,000 | 435 |
| Viscosity (cp), 99° C. (210° F.) | 355 | 38 |
| Water content (% v/v) | 2 | 0 |

TABLE 2

Viscosity (cp) of CN-38 and Deasphalted CN-38

| Temp (°C.) | CN-38 | Deasphalted CN-38 | % Reduction |
|---|---|---|---|
| 25 | 530,000 | 10,700 | 98.0 |
| 35 | 115,000 | 3,550 | 96.9 |
| 45 | 31,000 | 1,525 | 95.7 |
| 55 | 10,000 | 620 | 93.8 |
| 65 | 3,700 | 310 | 91.6 |
| 75 | 1,700 | 160 | 90.6 |
| 85 | 890 | 87 | 90.2 |

TABLE 2-continued

| Viscosity (cp) of CN-38 and Deasphalted CN-38 | | | |
|---|---|---|---|
| Temp (°C.) | CN-38 | Deasphalted CN-38 | % Reduction |
| 95 | 455 | 48 | 89.5 |

EXAMPLE 2

20 ppm of the demulsifier known under the Trade Name Nalco 3651 was injected into a second sample of the same crude oil which had previously been diluted by 15% w/w (19.5% v/v) pentane. The mixture was then heated to 60° C. and the separation of water was observed as a function of time.

The following results were obtained.

| Time (min) | % Total Water separated |
|---|---|
| 90 | 6.4 |
| 100 | 8.6 |
| 105 | 12.5 |
| 110 | 16.8 |
| 120 | 25.4 |
| 130 | 33.6 |
| 140 | 37.9 |
| 150 | 42.1 |
| 160 | 50.4 |
| 24 hrs | 62.9 |

EXAMPLE 3

The oil remaining after the partial separation of formation water (Example 2) was decanted and then pentane was added in a 6:1 w/w ratio (10:1 v/v) and 20 ppm Nalco 3651 was added to the mixture. The sample was heated to 60° C. and within 60 minutes over 50% of the remaining water separated together with the asphaltene fraction of the crude oil.

EXAMPLE 4

Demulsifier (20 ppm Nalco 3651) was injected into a crude oil emulsion (Cerro Negro 34, containing 28% w/w formation water) and mixed using a homogeniser. The mixture was then heated to 60° C. and the separation of water was observed as a function of time.

The amount of water separated after 24 hours was approximately 3% of the total water content of the crude oil.

Example 1 clearly demonstrates how the properties of the crude oil improve following the removal of its asphaltene fraction. The deasphalted crude oil is much less viscous and therefore easier to transport and contains lower concentrations of heavy metals.

A comparison of the data presented in Examples 2, 3 and on the one hand and 4 on the other illustrates how the addition of solvent facilitates the removal of water from crude oil emulsion. Example 3 illustrates how asphaltenes can be precipitated with the aqueous phase.

It is possible to calculate pipeline pressure drops and energy requirements for the two crude oils using the above data. These are presented in Table 3 and it is clear that the deasphalted crude oil requires considerably less energy for transportation.

TABLE 3

| Pipeline Properties<br>Flow Rate 100,000 BOPD (barrels of oil per day)<br>Diameter of pipeline 36 inches (91.4 cm) | | | | |
|---|---|---|---|---|
| Temperature °C. | CN 38 API 8.1 | | Deasphalted CN38 FPI 12.2 | |
| | P (lb/in$^2$ km) | Power Consumption (watts/km) | P (lb/in$^2$ km) | Power Consumption (watts/km) |
| 20 | 163.7 | 208923 | 30.0 | 38243 |
| 25 | 83.8 | 106879 | 16.9 | 21548 |
| 30 | 45.0 | 57416 | 9.9 | 12639 |
| 35 | 25.3 | 32250 | 6.1 | 7726 |
| 40 | 14.8 | 18867 | 3.8 | 4882 |

We claim:

1. A method for the treatment and transportation of a viscous crude oil produced in the form of an emulsion of fine droplets of formation water in oil, comprising the stages of dehydration, solvent deasphalting, solvent removal and transportation through a pipeline, said dehydration and solvent deasphalting capable of being carried out in a single zone or separate zones, said method comprising:

(a) adding a deasphalting/dewatering solvent to the emulsion of water in oil upstream of the dehydration and deasphalting stages, (b) separating water from oil in a dehydration stage, (c) withdrawing water from the dehydration stage, (d) precipitating asphalt in a deasphalting stage by contacting the oil with the solvent at a temperature in the range of 40° C. to 60° C. and removing asphaltenes from the deasphalting stage, (e) passing oil and solvent from the deasphalting stage to the solvent removal stage, and (f) withdrawing the oil of reduced water and asphaltene content from the solvent removal stage and transporting said oil through a pipeline.

2. A method according to claim 1 wherein dehydration and deasphalting are effected simultaneously within the same stage.

3. A method according to claim 1 wherein the ratio of the volume of solvent to the volume of crude oil is in the range 1:10 to 8:1.

4. A method according to claim 1 wherein a chemical demulsifier is added to the crude oil or organic solvent upstream of the dehydration stage.

5. A method according to claim 1 wherein treatment is effected at a temperature in the range 40° to 60° C.

6. A method according to claim 1 wherein the crude oil has an API Gravity in the range 5° to 15°.

7. A method according to claim 1 wherein the water associated with the crude oil is salt water and the salt content of the crude oil is reduced.

8. A method according to claim 1 wherein the organic solvent is selected from the group consisting of pentane, hexane, heptane and naphtha.

9. A method for the treatment and transportation of a viscous crude oil produced in the form of an emulsion of fine droplets of formation water in oil, comprising the stages of dehydration, solvent deasphalting, solvent removal and transportation through a pipeline, said method comprising:

(a) adding a deasphalting/dewatering organic solvent to the emulsion of water in oil upstream of the dehydration stage, (b) separating water from oil in a dehydration stage, (c) withdrawing water from the dehydration stage, (d) passing oil and solvent from the dehydration stage to the deasphalting stage, (e) adding a further quantity of solvent to the oil and solvent between the dehydration and the deasphalting stages, (f) precipitating asphalt in a deasphalting stage by contacting the oil with the solvent at a temperaturee in the range of 40°–60° C. and removing asphaltenes from the deasphalting stage, (g) passing the oil and solvent from the deasphalting stage to the solvent removal stage, and (h) withdrawing the treated oil of reduced water and asphaltene content from the solvent removal stage and transporting the oil through a pipeline.

10. A method according to claim 9 wherein (h) recovered solvent from the solvent removal stage is recycled to the dehydration and deasphalting stages.

11. A method according to claim 9 wherein the ratio of the volume of solvent added in Stage (a) to the volume of crude oil is in the range 1:20 to 1:2.

12. A method according to claim 11 wherein the ratio of the total volume of solvent added in Stages (a) and (d) to the volume of crude oil is in the range 1:10 to 8:1.

13. A method according to claim 9 wherein the solvent is selected from the group consisting of pentane, hexane, heptane and naphtha.

* * * * *